United States Patent [19]

Li et al.

[11] 3,942,524

[45] Mar. 9, 1976

[54] EMERGENCY BREATHER APPARATUS

[75] Inventors: Yi-Sheng Li, San Mateo; Eugene N. Perry, Sunnyvale; Robert B. Jagow, San Jose; Phillip A. Wagner, Sunnyvale, all of Calif.

[73] Assignee: The United States of America as represented by the Secretary of the Interior, Washington, D.C.

[22] Filed: Nov. 8, 1974

[21] Appl. No.: 522,169

[52] U.S. Cl. ..... 128/147; 128/191 R; 128/142 R; 55/387

[51] Int. Cl.[2] ..... A62B 7/08

[58] Field of Search..... 128/147, 191 R, 202, 203, 128/142, 142.6, 145 R, 188, 146.6; 55/387

[56] References Cited

UNITED STATES PATENTS

| | | | |
|---|---|---|---|
| 1,213,160 | 1/1917 | Davis | 128/202 |
| 2,403,991 | 7/1946 | Murphy et al. | 128/191 R |
| 2,695,022 | 11/1954 | Hamilton et al. | 128/191 R |
| 3,088,810 | 5/1963 | Hay | 128/191 R |
| 3,385,293 | 5/1968 | Phillips | 128/202 |
| 3,612,048 | 10/1971 | Takaoka | 128/191 R |
| 3,655,346 | 4/1972 | Cotabish et al. | 128/191 R |
| 3,685,971 | 8/1972 | Carson | 55/287 |
| 3,805,780 | 4/1974 | Cramer et al. | 128/188 |
| 3,830,632 | 8/1974 | Guzay | 128/191 R |

FOREIGN PATENTS OR APPLICATIONS

| | | | |
|---|---|---|---|
| 188,677 | 11/1922 | United Kingdom | 128/191 R |
| 192,633 | 8/1967 | U.S.S.R. | 128/191 R |

*Primary Examiner*—Robert W. Michell
*Assistant Examiner*—Henry J. Recla
*Attorney, Agent, or Firm*—Gersten Sadowsky; Donald R. Fraser

[57] ABSTRACT

A cannister has an inhalation chimney mounted thereon, and includes an inlet and an outlet. Several layers of $KO_2$ particles are contained in the cannister, separated by parallel screen assemblies, the upper two screen assemblies being connected by a vertical by-pass screen near the cannister inlet. The layered $KO_2$ bed is effective to remove $CO_2$ from exhaled breathe, and generate oxygen for recharging the air prior to inhalation. The cannister inlet is connected by a flexible hose to the exhalation side of a breather mouthpiece, the inhalation side of the mouthpiece being connected to the upper end of the inhalation chimney. Communication between the cannister outlet and the lower end of the inhalation chimney is provided by a breather bag, fitted with a set of baffles to define a tortuous flow path for cooling the processed air. A collector mounted at the cannister outlet prevents liquid $KO_2$ from entering the breather bag.

6 Claims, 7 Drawing Figures

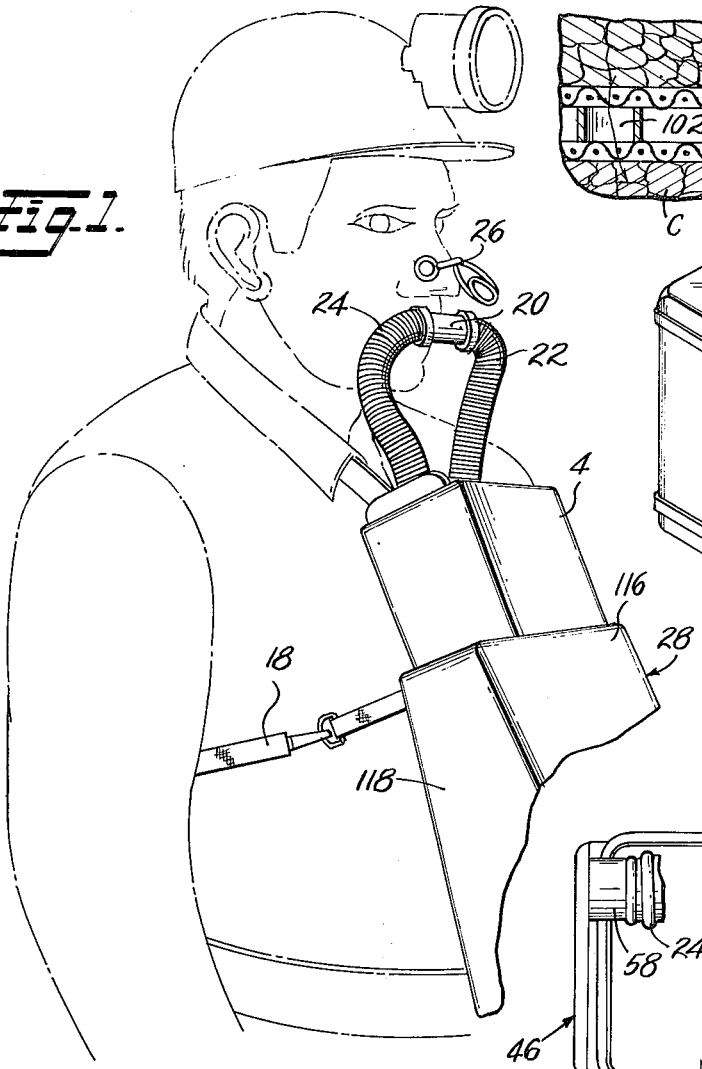
Fig. 1.
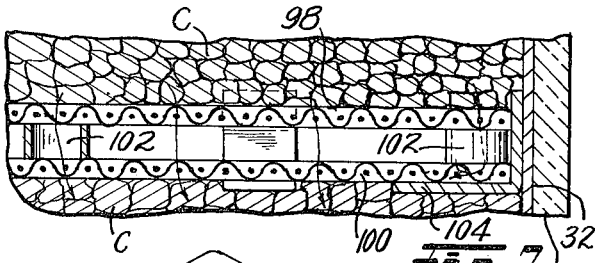
Fig. 7.
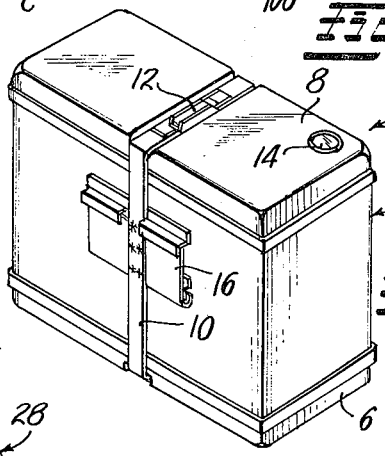
Fig. 2.
Fig. 4.
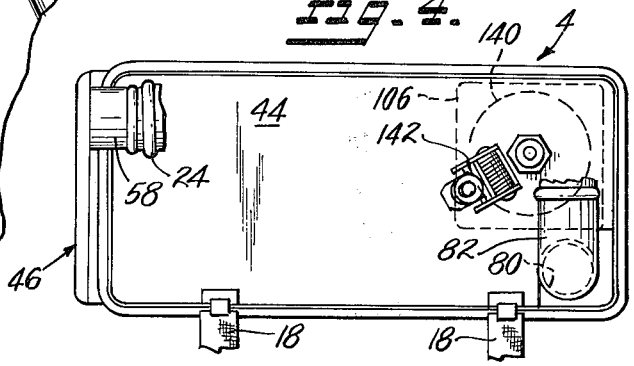
Fig. 5.
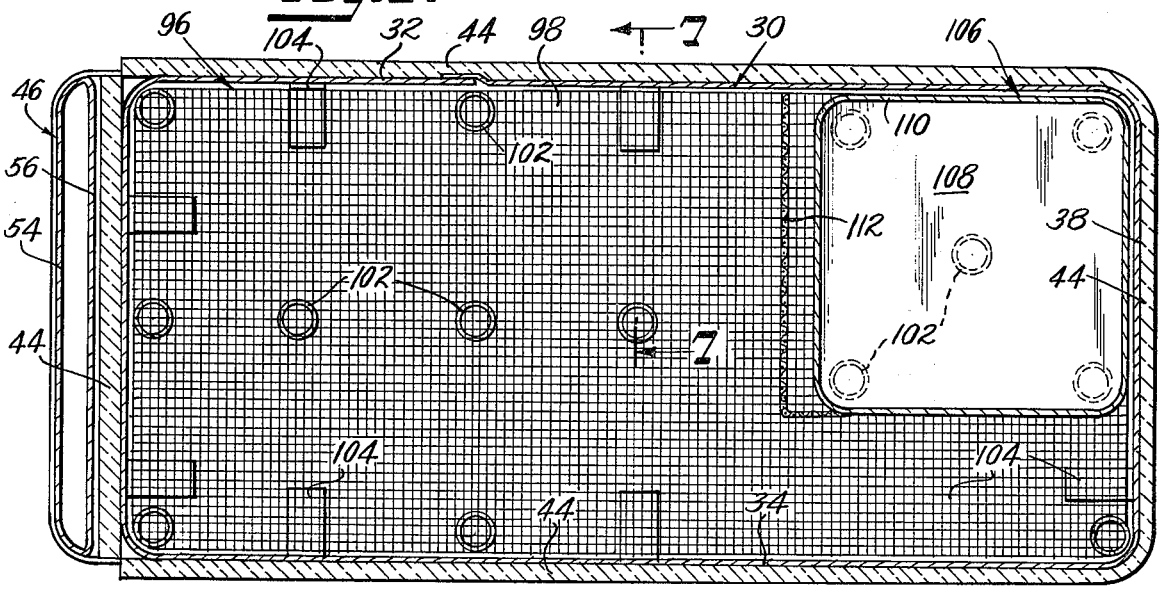

EMERGENCY BREATHER APPARATUS

BACKGROUND OF THE INVENTION

1. Field of the Invention

The present invention relates generally to emergency breather apparatus for use by miners and others to allow them to breathe in location where the ambient air is unsuited or dangerous for normal breathing. More particularly, it relates to a closed cycle breather apparatus designed to remove carbon dioxide from exhaled air, and to replace it with oxygen for inhalation by the user, the apparatus being light in weight, foolproof in operation, and designed to require minimum breathing effort to operate so that the user need not over exert.

2. Description of the Prior Art

In mining and other occupations there has long been a need for an efficient breather apparatus available for use in an emergency, when it becomes dangerous for a human being to breathe the ambient air. Over the years there have been many approaches to providing such apparatus, and typical of the device that have been developed are those shown in U.S. Pat. Nos. 2,913,317; 3,353,702; and 3,575,167.

None of the devices heretofore developed, however, possess all of the characteristics desirable for an emergency breather apparatus to be used on the job by a miner, mill worker or the like. Such apparatus must first of all be small and light in weight, so that it can be worn at all times by the potential user. It must be designed to be easily placed in use, with great reliability in the presence of prolonged storage and the shaking and vibration that can come from being worn on the body of a person engaged in hard physical labor.

In addition, the ideal apparatus is one that will not become fouled or jammed while in use, which provides adequate carbon dioxide removal and oxygen replenishing at a normal breathing temperature, and which can be operated by a substantially normal breathing effort so that no undue strain is placed upon the user. The present invention is designed to satisfy all of these characteristics, and thus meets an existing need in the emergency breather apparatus field.

SUMMARY OF THE INVENTION

The present invention has at its heart a cannister containing a layered bed of particles of potassium superoxide, or $KO_2$. When the exhaled breath from a user is passed over this chemical, carbon dioxide, or $CO_2$, is removed therefrom, and oxygen is released. This characteristic for $KO_2$ is already known to the art. The present apparatus is uniquely designed to maximize the results to be obtained by use of the chemical.

The cannister of the invention is generally rectangular, has an inlet at the top, and an outlet at the bottom. A plurality of spaced, parallel screen assemblies is placed within the cannister, the top two assemblies near the cannister inlet being connected by a transverse or vertically disposed bypass screen. The screen assemblies are placed in the cannister one at a time, and the space between each pair is filled with particles of $KO_2$. It has been found that there is an optimum range for the particle size of the $KO_2$, and for the thickness versus exposed area of each $KO_2$ bed layer.

The breather apparatus of the invention is provided with a means to collect the air exhaled by a user, and to supply air to be inhaled. While a mask can be utilized for this purpose, it has been found that a preferable element is a mouthpiece of the kind generally shown in U.S. Pat. No. 3,575,167, and which incorporates suitable exhalator and inhalator valves to provide alternate exhale and inhale modes. The exhalation side of the mouthpiece is connected by a flexible hose with the cannister inlet, and the cannister itself is provided with straps so that it can be readily worn by the user.

Mounted on the cannister opposite the inlet is a unique inhalation chimney, the upper end of which is connected to a flexible hose leading to the inhalation side of the mouthpiece. In order to provide communication between the cannister outlet and the lower end of the inhalation chimney, a breather bag is fitted over the lower end of the cannister.

When the $KO_2$ bed is operative to remove $CO_2$ and release oxygen, heat is also released. To protect the user and confine the heat within the cannister, the cannister is insulated. However, it is obvious that if the interior of the cannister is heated, then the temperature of air passing therethrough will be elevated. If such heated air is directly inhaled by the user, it could prove uncomfortably, or even dangerous over a prolonged period.

In order to cool the oxygen-replenished air before it is inhaled by the user, the interior of the breather bag is equipped with a plurality of baffles, arranged to define a long and tortuous flow path between the cannister outlet and the lower end of the inhalation chimney. During this time required to traverse this path, the processed air for inhalation is allowed to cool to a comfortable temperature.

Another problem with the use of $KO_2$ in such devices is that occasionally liquid $KO_2$ will be generated. This can be harmful, if it becomes entrained in the air to be inhaled. The present invention is equipped with a liquid $KO_2$ collector assembly at the cannister outlet, to guard against the liquid chemical entering into the breather bag.

Returning again to the configuration of the chemcial bed within the cannister, it has been found that in some instances the surface of a $KO_2$ bed exposed directly to moist exhaled air can become caked over a period of time. In past devices, when this caking has occurred the flow of air through the bed has been partially blocked, thereby greatly increasing the breathing effort required. In severe cases, where poor design is followed, total blockage is possible.

The bed arrangement of the invention is designed to avoid this problem, and that is the purpose of the transverse bypass screen connecting the upper two parallel screen assemblies. The bypass screen provides an alternate access to the $KO_2$ beds, ensuring that there will always be free access during the operating cycle of the apparatus.

In order to initially charge the $KO_2$ bed with oxygen upon activation of the emergency breather apparatus, a conventional oxygen candle ignited by a trigger mechanism is employed. The trigger mechanism is designated to be actuated that is light in weight, which can be worn by the user at all times while engaged in his occupation, and which is effective when activated to remove $CO_2$ from exhaled breath and supply oxygen-replenished air at a comfortable breathing temperature.

Another object is to provide such a breather apparatus, designed to require a minimum of breathing effort on the part of the user.

Yet another object is to provide a chemical bed arrangement for such a breather apparatus, designed to provide for alternate flow paths in case the normally first exposed surface area becomes caked and impervious, and to obtain maximum efficiency from the chemical.

Other objects and many of the attendant advantages of the present invention will become readily apparent from the following Description of the Preferred Embodiments when taken in conjunction with the accompanying drawings.

BRIEF DESCRIPTION OF THE DRAWINGS

FIG. 1 is a pictorial view of the emergency breathing apparatus of the present invention in use;

FIG. 2 is a perspective view of an assembled package unit containing the breathing device of FIG. 1, as it is to be worn by the potential user;

FIG. 4 is a top plan view of the device, taken along the line 4—4 of FIG. 3;

FIG. 5 is an enlarged horizontal sectional view partly in section, taken on line 5—5 of FIG. 3;

FIG. 7 is an enlarged fragmentary vertical sectional view, taken on the line 7—7 of FIG. 5, and showing in particular the construction of one of the intermediate screen assemblies

DESCRIPTION OF THE PREFERRED EMBODIMENTS

Figure 3:
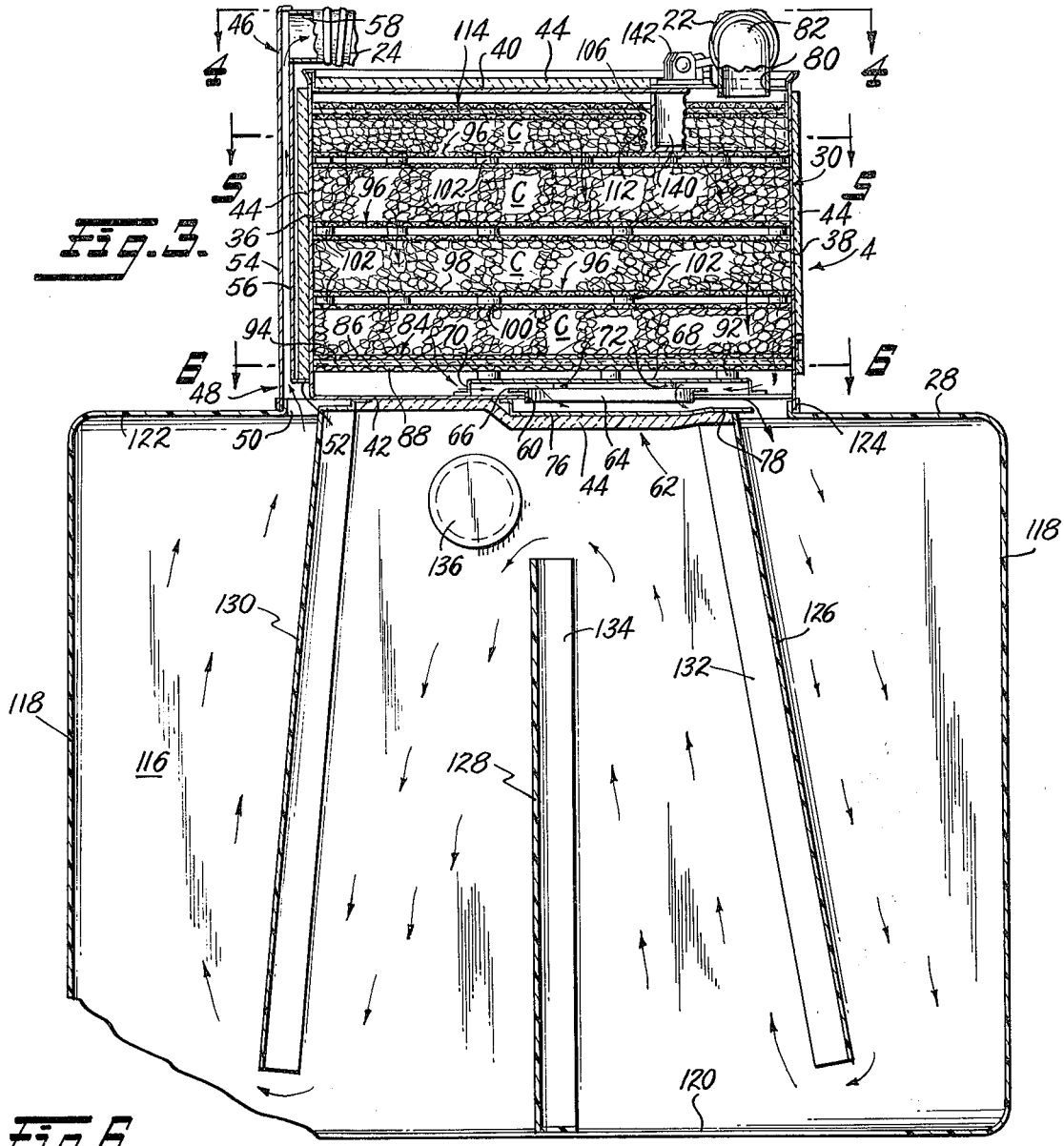
FIG. 3 is a fragmentary, broken vertical sectional view of the breathing apparatus of the invention, showing the direction of air flow therethrough.
Figure 6:
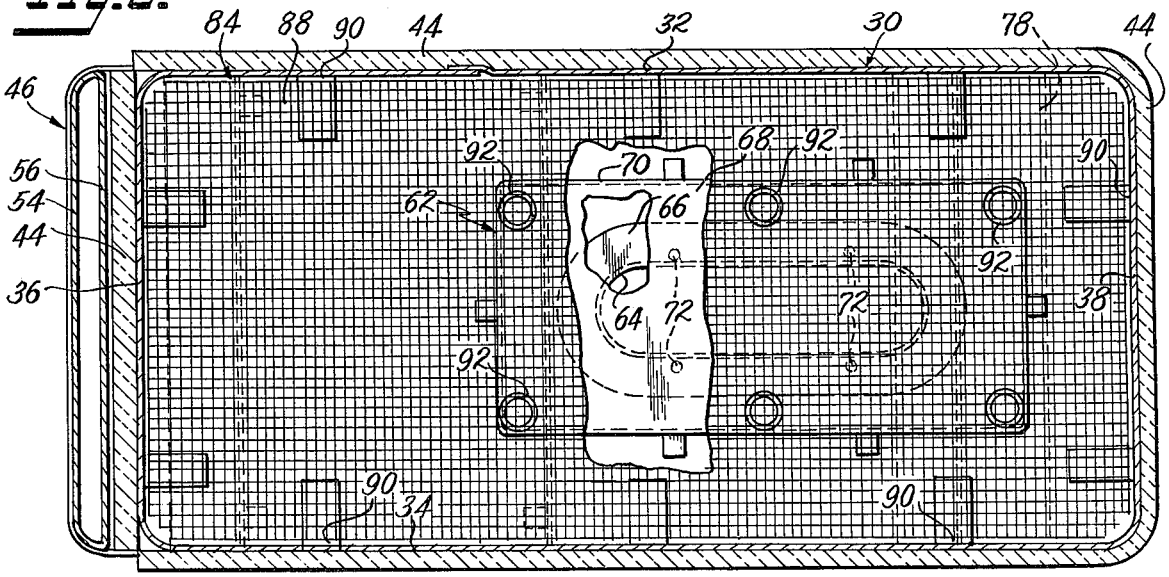
FIG. 6 is a fragmentary horizontal sectional view, similar to FIG. 5, taken on the line 6—6 of FIG. 3, and showing in particular the arrangement of the liquid $KO_2$ collector assembly.

Referring now to the drawings, an assembled package unit of the breather apparatus of the invention is shown at 2 in FIG. 2, as such would be worn by a workman. The unit 2 includes a central cannister assembly 4, a lower lid 6 and an upper lid 8, the lids 6 and 8 being sealed to the central cannister assembly 4 by O-rings or other suitable sealing arrangements (not shown), and being held in assembled relation by a circumferential strap 10 equipped with an over-center release catch 12. The upper lid 8 has an inspection window 14 therein, and the strap 10 also serves to mount a clip 16 of suitable design to attach the unit 2 to the belt of the wearer.

The unit 4 is normally worn on the belt during working duties, and if it is needed the worker grasps it, operates the catch 12, removes the strap 10, and the upper and lower lids 8 and 6. Stowed beneath the upper lid 8 are body straps 18, which the workman then dons. Also stowed beneath the upper lid 8 is a breather mouthpiece 20, having flexible exhalation and inhalation hoses 22 and 24, respectively connected to the opposite ends thereof, and equipped with noseclips 26. After putting on the cannister assembly 4 and the body straps 18, the workman lifts the mouthpiece 20 from the cannister assembly and places it in his mouth, thereby automatically activating the apparatus, in a manner to be described hereinafter.

Stowed beneath the lower lid 6 is a breather bag 28, and such falls free when the lower lid 6 is removed. With the apparatus thus mounted on his body, the worker can now commence relatively normal breathing through the apparatus.

Turning now to the cannister assembly 4, such includes a rectangular cannister 30 of sheet material and including side walls 32 and 34, end walls 36 and 38, a top wall 40, and a bottom wall 42, all of which have insulation 44 secured to the exterior thereof. Mounted to the end wall 36 of the cannister 30 is an inhalaton chimney 46, including an elongated lower portion 48 that is formed as part of a depending skirt 50 extending around the lower periphery of the cannister 30, the lower chimney portion 48 being defined in part by a short upper wall 52 that extends from the cannister end wall 36, but stops short of the outer wall 54 of the chimney 46. Extending upwardly from the upper wall 52 is an inner chimney wall 56, the space between the inner chimney wall 56 and the end wall 36 receiving the insulation 44.

At its upper end the chimney 46 is closed off, except for a nipple 58 to receive one end of the inhalation hose 24. The inhalation chimney 46 is thus seen to be spaced over the major portion of its length from the cannister end wall 36, with insulation therebetween, whereby heat transfer from the cannister to the chimney 46 is minimized.

The bottom wall 42 of the cannister 30 has an outlet opening 60 cut therein, about which is mounted a liquid $KO_2$ collector assembly 62. The collector assembly 62 includes a sleeve 64 welded within the opening 60, and having an external flange 66 on the upper end thereof that extends parallel to and that is spaced from the bottom wall 42. Mounted over the flanged sleeve 64 is an inverted member 68 having a skirt 70 thereon that is welded to the bottom wall 42, the member 68 being spaced above the flange 66 by spacers 72, and the skirt 70 having a plurality of flow openings 74 cut therein. The collector assembly 62 is completed by a baffle plate 76 mounted below the outlet opening 60 and spaced from the lower end of the flanged sleeve 64, the outer, open end 78 of the baffle plate being bent upwardly to form a lip.

In use, should liquid $KO_2$ be formed in the apparatus, it will naturally fall to the bottom wall 42. In order to reach the outlet opening it must first flow up on the skirt 70 of the member 68, and through the openings 74. This constitutes a first barrier. If a sufficient liquid creation occurs to cause liquid to flow through the flow openings 74, then a second barrier is created by the damning effect of the upper flanged end 66 of the sleeve 64. Should liquid $KO_2$ ultimately flow up and over the flange 66, then it will be caught on the baffle plate 76, which constitutes the third barrier. Any liquid $KO_2$ reaching the baffle plate 76 normally will have cooled substantially before reaching the same, and will quickly turn to a solid state on said plate.

The result of the novel collector assembly 62 is that in all normal operating conditions no escape of liquid $KO_2$ into the breather bag 28 can occur. At the same time, full air flow is provided for, with no flow restrictions.

The top wall 40 of the cannister 30 has an inlet opening 80 therein, positioned near the corner formed by the sidewall 34 and the end wall 38, so that the inlet is at the opposite side of the cannister 30 from the inhalation chimney 46. The lower end of an elbow 82 is welded in the inlet opening 80, the other end thereof being connected to one end of the exhalation hose 22.

Mounted within the cannister 30 are several parallel filter screen assemblies, which serve to position the $KO_2$ chemical properly and in layers of the correct depth. The bottom screen assembly 84 is also a filter, and includes top and bottom screens 86 and 88 made of wire or the like, say with about an 8 by 8 mesh. Attached to the side edges of the screens are several spaced, L-shaped brackets 90 that are utilized to secure the screens to the sidewalls of the cannister 30, the bottom screen 88 being spaced above the bottom wall 42 of the cannister by a plurality of tubular spacers 92 disposed between the screen and the member 68. Sandwiched between the screens 86 and 88 of the bottom filter screen assembly 84 is a filter element 94 intended for filtering foreign particles from the re-charged air. Any suitable material can be used for the filter element 94, such as the product known as "Micro-Fiber Web, Code 110", made commercially by the Johns-Manville Company.

After the bottom filter screen assembly 84 is in place, layer C of the $KO_2$ particles is placed thereon to the desired depth, and then an intermediate screen assembly 96 is installed in the cannister 30. The intermediate screen assemblies 96 each include upper and lower screens 98 and 100 like the screens 86 and 88, held in spaced-apart relationship by a plurality of short, spaced tubular spacers 102 (FIG. 7). The edges of the screens 98 and 100 have L-shaped brackets 104 thereon, for securing them to the wall of the cannister. The spaced-apart arrangement thereof provides a flow redistribution space between the layers of the $KO_2$ bed of the invention, thereby aiding flow and reducing the required breathing effort.

Further intermediate screen assemblies 96 are installed, and further layers C of the $KO_2$ chemical, until an intermediate screen assembly 96 is installed over the next to the top layer C of chemical. A different construction is provided for the top layer of the chemical bed, to guard against interference in the normal operation of the apparatus of the invention because of surface caking of the $KO_2$.

It is known that under certain circumstances, particularly at the start of an operating cycle when the incoming exhaled breath may be filled with moisture, a chemical reaction can occur with $KO_2$ that will cause caking of the outer exposed surface thereof. Should this occur, then the effectiveness of the breather apparatus can be hampered or even destroyed. In order to solve this problem, a bypass arrangement around the top-most surface of the chemical bed is provided in the invention.

Referring in particular to FIGS. 3 and 5, it is seen that in the corner of the cannister formed by the walls 32 and 38 a sheet metal shield 106 is secured in place on the top-most intermediate screen assembly 96, the shield comprising a base plate 108 having an upstanding peripheral flange 110 thereon. Outwardly of the shield 106 and parallel to the end wall 38 a vertical bypass screen element 112 is erected on the top-most intermediate screen assembly 96, to extend vertically to an upper filter screen assembly 114 made up and secured like the lower filter screen assembly 84.

The volume defined by the walls of the cannister 30, the top-most intermediate screen assembly 96, the upper filter screen assembly 114, and the vertical or transverse bypass screen 112 is filled with a layer C of the $KO_2$ chemical. Thereafter, the normal course for entering air to follow is downwardly through the upper filter screen assembly 114 and into the top layer of $KO_2$ through the upper surface thereof, the upper filter screen assembly 114 being spaced from the top wall 40 of the cannister 30 to provide for such air flow. Should the top surface of the upper $KO_2$ bed become caked and thus wholly or partially impervious, the bypass screen 112 arrangement provides an alternate flow path into the $KO_2$ bed. The invention thus ensures that there will be no impedance of the operating effectiveness of the invention, due to caking of the $KO_2$ outermost surface.

Having thus described the mechanical arrangement of the $KO_2$ bed within the cannister 30, a consideration of some of the preferable parameters thereof is in order. It has been found that a preferantial grain size range for the $KO_2$ chemical in the present arrangement is from about 174 to about 4 mesh. Further, it has been determined that there is an optimum range for the ratio of the thickness of each layer of $KO_2$ to the surface area thereof, or that area defined when looking down upon a given layer from the top of the cannister 30. That perferential ratio range is from about 0.035 to about 0.045. Given this preferential ratio range, and knowing the total amount of $KO_2$ required to furnish oxygen over the expected operational time, the number of layers C required of the $KO_2$ chemical can be calculated.

The basic limitations in using $KO_2$ for the purposes of the invention are its tendency to cake, which is solved by the bypass screen arrangement and the separated layers of the chemical bed, and the tendency for the grains to fuse together. The grain size range indicated herein as preferable has been found to offer minimum fusion tendencies to the particle in the bed layers.

Since a part of the necessary operation of the invention is to remove $CO_2$ from the exhaled breath, and since some dwell time with the chemical bed is necessary for this to occur, a finite depth must be present. The ratio ranges given herein have been found to offer the optimum tradeoffs among $CO_2$ removal, ease of breathing effort, and generation of oxygen.

Both the oxygen production and the carbon dioxide absorbing processes that occur in the $KO_2$ bed are exothermic, and produce considerable heat. Since the inspired air and the exterior apparatus surfaces have definite temperature limits, attention must be paid to this heat generation, which theoretically for a one pound charge of $KO_2$ could be as high during an operating cycle as 670 BTU's. In particular, care must be taken so that the inhaled, regenerated air is sufficiently cool before it reaches the lungs of the user, and it is precisely to achieve this that the inhalator chimney 46 and the breather bag 28 are provided. The insulation 44, of course, protects the user's body from the hot cannister 30.

Turning now to FIGS. 1 and 3, the breather bag 28 is made from a suitable pliant or flexible material, say rubber or plastic. It includes side walls 116, end walls 118, a bottom wall 120, and a top wall 122, the latter having an opening formed therein ringed with a collar 124 that is bonded or otherwise secured in an air-tight manner to the circumferential skirt 50. With the breather bag 28 in place, communication is established between the cannister outlet sleeve 64 and the lower, enlarged inlet end 48 of the inhalation chimney 46. If such communication is direct, however, it has been found that adequate cooling of the re-charged air may not occur before it reaches the lungs of the user.

In order to provide a longer dwell time in the exposed breather bag 28, which as has been explained in initially protected from damage by being folded within the lower cover 6, the bag is fitted with a plurality of baffles 126, 128 and 130. The first baffle 126 is positioned with its upper end just inside the lip 78 of the baffle plate 76, and is secured to the opposite sidewalls 116 of the bag by flanged portions 132. The baffle 126 extends nearly to the bottom of the bag, and acts to direct the airflow downwardly toward the bag bottom.

The intermediate baffle 128 is secured by flanges 134 to the bottom wall 120 and the sidewalls 116 of the bag 28, and extends nearly to the top wall 122. Finally, the last baffle 130 is mounted like the first baffle 126. Together, the baffles require the air discharged from the cannister 30 to follow a tortuous and lengthy path through the breather bag 28, allowing for adequate cooling thereof.

In operation, when the user breathers or exhales into the mouthpiece 20, the exhalator valve therein channels the air into the flexible pipe 22, from where it flows through the cannister 30 and into the breather bag 28. The breather bag 28 acts as a lung to store the recharged air, as well as a means to cool it. Should excess pressure build up therein, a relief valve 136 will open to release it. When the user then inhales, oxygen-recharged air will flow into his lungs from the bag 28 through the inhalation chimney 46, flexible pipe 24, and the mouthpiece 20.

It is normal practice to initially charge a breather apparatus with oxygen just before its use, so that no time delay is involved before the user can breathe effectively. An oxygen candle is normally used for this purpose, say of the general type shown in U.S. Pat. No. 2,753,015. Such an oxygen candle is shown at 140 in the present invention, positioned to discharge into the shield 106, although another location on the top wall 44 of the cannister 30 can be chosen. A spring-actuated igniter 142 is mounted on the wall 44 in position to strike and ignite the oxygen candle 140, and is so arranged as to be connected with the mouthpiece 20 and hoses 22 and 24 when such are in their stored positions within the top cover 8. The connecting means is so arranged that when, after removal of the top cover 8, the mouthpiece 20 and the hoses 22 and 24 are forcefully pulled away from the cannister top wall 44, the igniter 142 is activated to strike and ignite the oxygen candle 140. This arrangement is known in the art.

From the foregoing description and drawings, it is believed evident that an emergency breather apparatus has been provided that satisfies all of the objects set forth for the invention. Obviously, many modifications and variations are possible.

We claim:

1. An emergency breather apparatus, comprising; a cannister having an inlet and an outlet; chemical bed means within said cannister to absorb $Co_2$ and release oxygen when the exhaled breath from a user wearing the apparatus passes therethrough; the chemical bed means capable of partially liquifying upon contact with the exhaled breath from a user; an inhalation chimney carried by said cannister; means wearable by a user for collecting exhaled breath, and furnishing air for inhalation, the exhalation side of said means being connected with the inlet of said cannister, and the inhalation side thereof being connected with one end of said inhalation chimney; and a breather bag carried by said cannister and connecting said outlet with the other end of said chimney, wherein said cannister includes a generally flat bottom wall and said outlet comprises an opening in said bottom wall including means mounted at said outlet for collecting liquified chemical bed means to prevent its passage into said breather bag; said collecting means including a sleeve secured within said outlet and including an external flange on the upper end thereof spaced from said bottom wall, and a baffle plate mounted on the exterior of said bottom wall to extend across said outlet, spaced from said bottom wall.

2. An emergency breather apparatus as recited in claim 1, wherein said chemical bed means comprises a plurality of layers of $KO_2$, separated by screen means.

3. An emergency breather apparatus as recited in claim 2, wherein said screen means disposed between each pair of layers of $KO_2$ comprises a pair of screens mounted with a space therebetween to provide for redistribution of flow from one layer to the next.

4. An emergency breather apparatus as recited in claim 2, wherein said $KO_2$ comprises particles having a size range of from about 174 to about 4 mesh.

5. An emergency breather apparatus as recited in claim 2, wherein the ration of the thickness of each layer of $KO_2$ to the surface area thereof is within the range of from about 0.035 to about 0.045.

6. An emergency breather apparatus as recited in claim 1, wherein said collecting means further includes: an inverted, skirted member disposed over said opening and said flange and spaced therefrom, the skirt of said inverted member having slot openings therein for the passage of air.

* * * * *